US006992637B2

(12) United States Patent
Hwang et al.

(10) Patent No.: US 6,992,637 B2
(45) Date of Patent: Jan. 31, 2006

(54) SLOT ANTENNA HAVING SLOTS FORMED ON BOTH SIDES OF DIELECTRIC SUBSTRATE

(75) Inventors: Jung Hwan Hwang, Daejon-Shi (KR); Sung Hae Jung, Daejon-Shi (KR); Woo Seok Yang, Daejon-Shi (KR); Jae Woo Lee, Gwangiu-Shi (JP); Sung Weon Kang, Daejon-Shi (KR); Yun Tae Kim, Daejon-Shi (KR)

(73) Assignee: Electronics and Telecommunications Research Institute, Daejon-Shi (KR)

( * ) Notice: Subject to any disclaimer, the term of this patent is extended or adjusted under 35 U.S.C. 154(b) by 69 days.

(21) Appl. No.: 10/743,459

(22) Filed: Dec. 23, 2003

(65) Prior Publication Data

US 2005/0057412 A1 Mar. 17, 2005

(30) Foreign Application Priority Data

Aug. 27, 2003 (KR) ..... 10-2003-0059604

(51) Int. Cl.
*H01Q 13/10* (2006.01)

(52) U.S. Cl. ..... 343/770; 343/767; 343/700 MS

(58) Field of Classification Search ..... 343/767, 343/770, 771, 700 MS
See application file for complete search history.

(56) References Cited

U.S. PATENT DOCUMENTS 5,977,916 A * 11/1999 Vannatta et al. ..... 343/702
6,133,879 A * 10/2000 Grangeat et al. .... 343/700 MS
6,407,715 B1 * 6/2002 Chen ..... 343/767
6,515,626 B2 * 2/2003 Bark et al. ..... 343/700 MS
6,515,630 B2 * 2/2003 Honda ..... 343/702
6,618,020 B2 * 9/2003 Wang et al. ..... 343/767
6,636,183 B1 * 10/2003 Hellgren et al. ..... 343/767
6,664,931 B1 * 12/2003 Nguyen et al. ..... 343/767

FOREIGN PATENT DOCUMENTS

KR 2001-63379 7/2001
KR 2002-65811 8/2002

OTHER PUBLICATIONS

H. Y. Wang, et al; "*Compact Meander Slot Antennas*"; Microwave and Optical Technology Letters; vol. 24, No. 6; Mar. 20, 2000; pp. 377-380.
Jung-Min Kim, et al.; *Compact Meander-Type Slot Antennas 0-7803-7070-8/01/$10.00© 2001 IEEE*; pp. 724-727.

* cited by examiner

*Primary Examiner*—Hoang V. Nguyen
*Assistant Examiner*—Leith A. Al-Nazer
(74) *Attorney, Agent, or Firm*—Mayer, Brown, Rowe & Maw LLP

(57) ABSTRACT

The present invention is provided to manufacture a slot antenna having slots formed on both sides, that is, a top and a bottom of a dielectric substrate, wherein electric fields in the slots are generated in the utmost same direction. According to this structure, it is possible to realize a compact and lightweight slot antenna having higher gain and radiation efficiency characteristics in comparison with the conventional meandered slot antenna.

2 Claims, 23 Drawing Sheets

Elevation Pattern Gain Display
(dBi)

E-Plane

Elevation Pattern Gain Display
(dBi)

H-Plane

Elevation Pattern Gain Display
(dBi)

E-Plane

Elevation Pattern Gain Display
(dBi)

H-Plane

Elevation Pattern Gain Display
(dBi)

E-Plane

Elevation Pattern Gain Display
(dBi)

H-Plane

SLOT ANTENNA HAVING SLOTS FORMED ON BOTH SIDES OF DIELECTRIC SUBSTRATE

BACKGROUND

1. Field of the Invention

The present invention relates to a slot antenna, and more specifically to a slot antenna having slots formed on both sides of a dielectric substrate.

2. Discussion of Related Art

In recent, as information and communication technologies developed rapidly, the radio communication system has been developed to transmit various wideband data such as multimedia data differently from the conventional radio communication system for transmitting only voice. A radio communication terminal used in a radio communication system becomes compact and lightweight as portability of the radio communication is important.

Accordingly, wide band, compact, and lightweight antenna used in the radio communication terminal will be required. Normally, a microstrip patch antenna is used as a compact and lightweight antenna. However, there is a problem that a frequency bandwidth of the microstrip patch antenna is very narrow. On the other hands, the slot antenna has relatively wide frequency bandwidth and low cross polarization level characteristics.

Now, the conventional slot antenna will be described with reference to accompanying drawings.

FIG. 1A is a view showing a basic structure of the conventional slot antenna. The slot antenna in FIG. 1A comprises a dielectric substrate 11 having a predetermined dielectric constant and thickness, a slot 12 having a length of ½ center frequency wavelength λ on one surface of the dielectric substrate, and a microstrip feed line 13 for supplying electromagnetic field energy to the slot 12 formed on the other surface of the dielectric substrate. Reference numeral 14 indicates a ground surface formed on the one surface of the dielectric substrate 11.

FIG. 1B is a view showing an electric field distribution generated by the electric field energy, which is supplied to the slot 12 through the microstrip feed line 13. The electromagnetic field is radiated into free space through the generated electrical field. This slot antenna has relatively wide frequency bandwidth characteristics. However, since a slot having a λ/2 length should be formed on the antenna, there is a problem that the slot antenna becomes large.

Accordingly, in the art, a meandered slot antenna has a structure capable of reducing a size of the antenna by forming the slot in the antenna to have a horizontally bended form in order to reduce a size of the conventional slot antenna. The meandered slot antenna structure was disclosed in Microwave and Optical Tech Letters, vol. 24, pp. 377–380, 2000, entitled "compact Meander Slot Antennas," written by H. Y. Wang, J. Simkin, and Jung-Min Kim, Jong-Gwan Yook, "compact Meander-Type Slot Antennas," and Antennas and Propagation Society, 2001 IEEE International Sym., vol. 2, pp. 724–727, 2001".

FIG. 2A is a view showing a basic structure of the conventional meandered slot antenna. The meandered slot antenna comprises a dielectric substrate 21, a slot 22 formed on one surface of the dielectric substrate, and a microstrip feed line 23 formed on the other surface of the dielectric substrate to supply electromagnetic field energy to the slot 22. The slot 22 is horizontally formed to have a "ㄹ" shape, that is, a meandered shape on one surface of the dielectric substrate 21. The slot antenna having a length of ½ center frequency wavelength is gradually decreased in size depending on the bending number of the slot. Reference numeral 24 indicates a ground surface formed on the one surface of the dielectric substrate 21.

The electric field distribution of the slot antenna having the slot 22 of the meandered structure is shown in FIG. 2B. In the slot 22 in FIG. 2B, an electric field component A and an electric field component B are arranged in parallel and in opposite directions to be counterbalanced, thereby reducing the electromagnetic energy radiated from the slot.

Accordingly, a gain and a radiation efficiency of the meandered slot antenna, defined by an equation (1) and (2), are very low.

$$\text{Gain}=4\pi(\text{Radiation strength}/\text{Antenna input power}) \quad (1)$$

$$\text{Radiation efficiency}=(\text{Radiation power}/\text{Antenna input power}) \quad (2)$$

As shown in the equations 1 and 2, the gain and the radiation efficiency of the antenna are indexes representing magnitude of the radiated energy with the exception of energy lost by loss factors of dielectric or conductor of the antenna or energy lost around the periphery of the antenna as a reactance component. It means that if the gain and the radiation efficiency of the antenna are increased, energy radiated from the antenna is also increased.

FIG. 3 is a view showing dimensions of the slot antenna and the meandered slot antenna used in a simulation test for monitoring decrement in the gain and the radiation efficiency according to a meandered structure of the slot. A width of the slot is 0.3 mm. In this case, the gain and the efficient of the antennas are represented in table 1. At that time, the used substrate has characteristics, such as a thickness of 100 μm, a permittivity of 12.9, a loss tangent of 0.002, and a center frequency of 5.775 GHz. As shown in table 1, it is understood that the gain and the radiation efficiency of the antenna are decreased by 6 dBi and 30% respectively when the meandered structure is used in the slot.

TABLE 1

| | SLOT ANTENNA | MEANDERED SLOT ANTENNA |
|---|---|---|
| 10 dB FREQUENCY BAND WIDTH (MHz) | 30.0 | 40.0 |
| ANTENNA GAIN(dBi) | −1.0 | −7.0 |
| ANTENNA RADIATION EFFICIENCY (%) | 40.0 | 10.0 |

Accordingly, since the conventional slot antennas still cannot concurrently satisfy both characteristics, that is, gain and radiation efficiency characteristics and compact and lightweight characteristics, it is fully necessary to develop a new shaped slot antenna.

SUMMARY OF THE INVENTION

Therefore, the present invention is contrived to solve the aforementioned problems in the art.

The present invention is directed to a new shaped slot antenna capable of improving gain and radiation efficiency thereof.

Furthermore, the present invention is also directed to a slot antenna capable of distributing an electric field on neighbor slots in the same direction as well as satisfying compact and lightweight characteristics.

As a technical means for solving the aforementioned problems, an aspect of the present invention comprises a first dielectric substrate including slots formed on a top and a bottom of the first dielectric substrate, ground surfaces formed on the top and the bottom respectively, and a first connection unit for connecting ground surfaces formed on the top and the bottom; and a second dielectric substrate, which is stacked on the first dielectric substrate, including a microstrip feeding line formed on the bottom of the second dielectric substrate to feed electromagnetic energy and a second connection unit for connecting the microstrip feeding line and the ground surface formed on the bottom of the first dielectric substrate.

Another aspect of the present invention comprises slots formed on a top and a bottom of a dielectric substrate; ground surfaces formed on the top and the bottom as a structure for defining the slots; and a microstrip feed line formed to be electrically isolated from the ground surface on the top of the dielectric substrate, to be electrically connected through connection unit at the ground surface on the bottom of the dielectric substrate, and to be crossed with the slots formed on the bottom of dielectric substrate.

BRIEF DESCRIPTION OF THE DRAWINGS

The above and other objects, advantages and features of the present invention will become apparent from the following description of preferred embodiments given in conjunction with accompanying drawings, in which.

DETAILED DESCRIPTION OF PREFERRED EMBODIMENTS

Figure 1A:
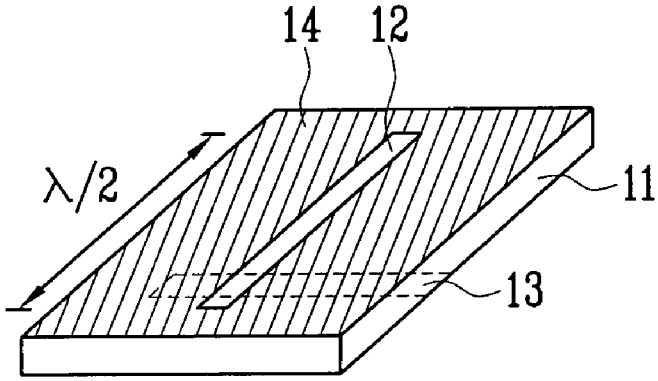
FIG.1A (PRIOR ART)
FIGS. 1A and 1B are views showing a basic structure of the conventional slot antenna.
Figure 1B:
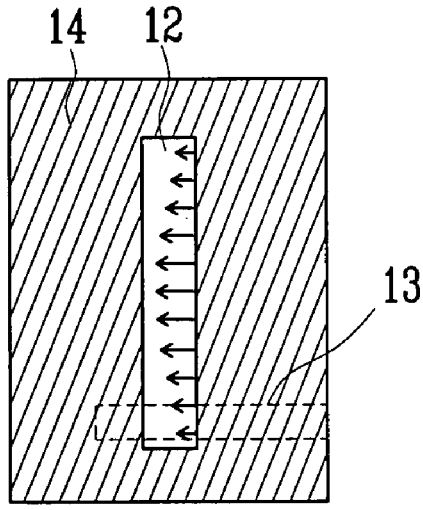
FIG.1B (PRIOR ART)
Figure 2A:
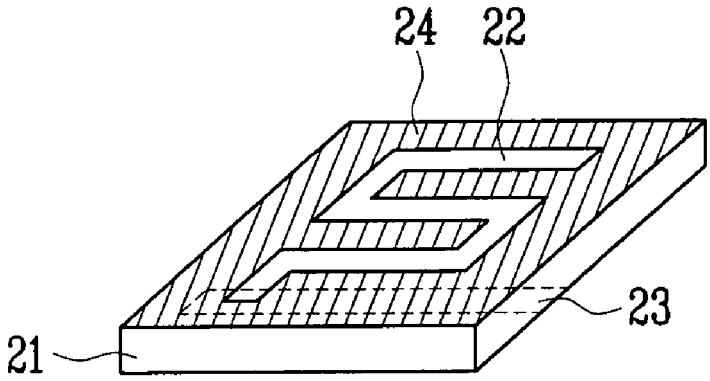
FIG.2A (PRIOR ART)
FIGS. 2A and 2B are views showing a basic structure of the conventional meandered slot antenna.
Figure 2B:
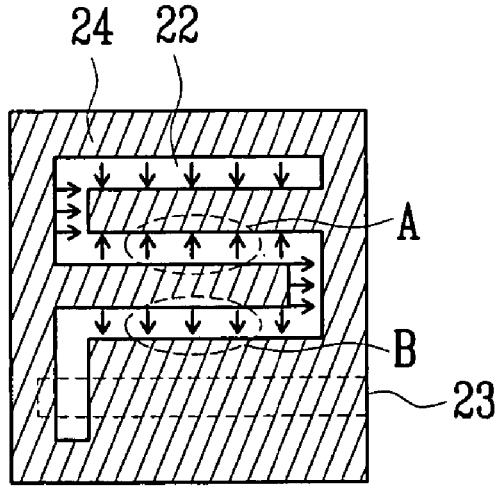
FIG.2B (PRIOR ART)
Figure 3:
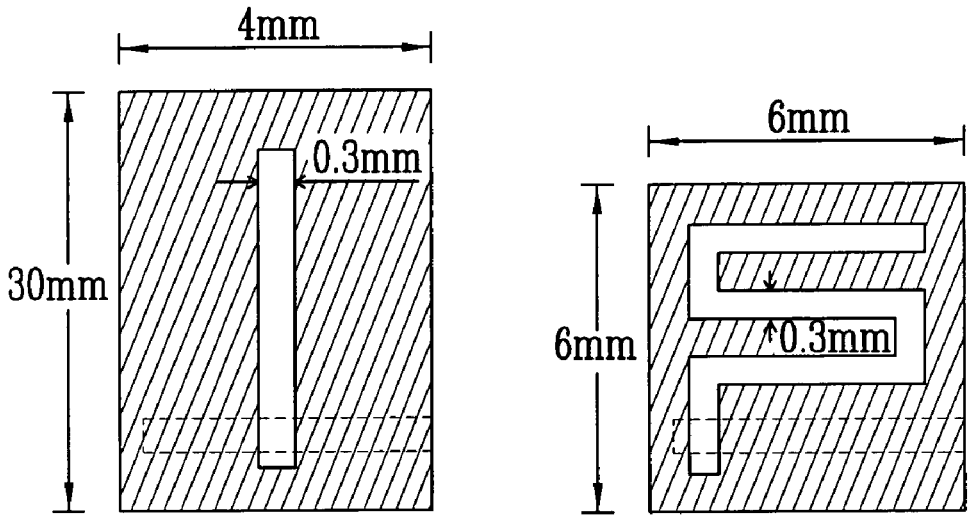
FIG.3 (PRIOR ART)
FIG. 3 is a view showing dimensions used in a simulation test of the conventional slot antenna and meandered slot antenna.

Now, preferable embodiments of the present invention will be described with reference to accompanying drawings. However, the present invention is not limited to the preferred embodiments disclosed in the following description, but can be implemented into various changes and modifications. Thus, these embodiments according to the invention are for informing those skilled in the art of the scope of the present invention. Furthermore, the same component in the drawings is referred to the same numeral and will not be described specifically in order to avoid redundancy.

(First Embodiment)

Figure 4A:
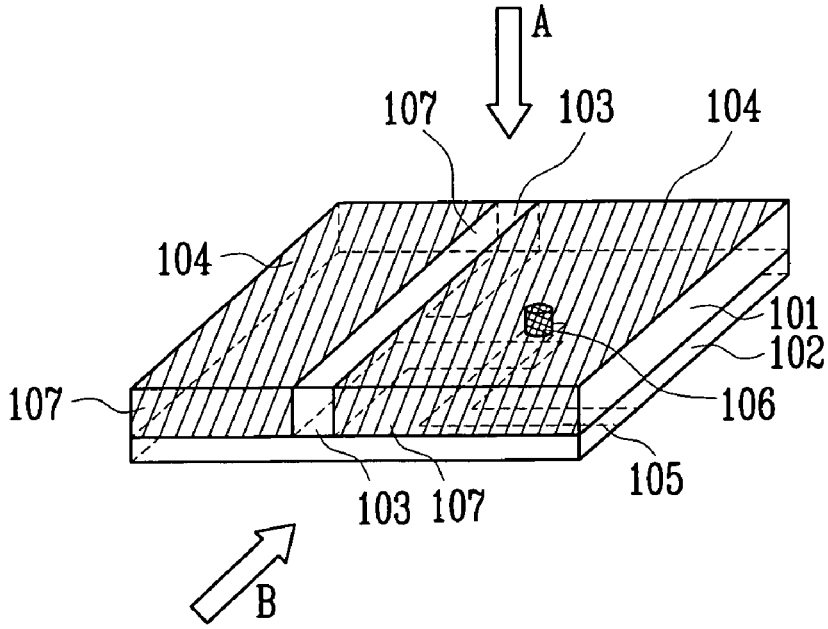
FIGS. 4A to 4C are views showing a slot antenna structure according to a first embodiment of the present invention.

FIG. 4A is a view showing a slot antenna structure according to a first embodiment of the present invention. The slot antenna in FIG. 4A comprises first and second dielectric substrates 101, 102 having a predetermined permittivity and thickness in which slots 103 and a microstrip feed line 105 are formed, slots 103 each formed on both sides, that is, a top and a bottom of the first dielectric substrate 101 in order to radiate an electromagnetic field, ground surfaces 104 each formed on the top and the bottom of the first dielectric substrate as a structure defining the slot, a microstrip feed line 105 formed on a bottom of the second dielectric substrate 102 to feed an electric field energy, conduction via holes 106 formed in the second dielectric substrate 102 to match impedance of the microstrip feed line, and connection units (for example, conduction walls) 107 formed to connect the ground surface 104. According to the embodiment of the present invention, the slot 103 of the slot antenna formed on one side of the dielectric substrate is bended at both ends of the dielectric substrate 101 so that both end portions of the slot 103 are placed on the bottom of the first dielectric substrate 101.

Figure 4B:
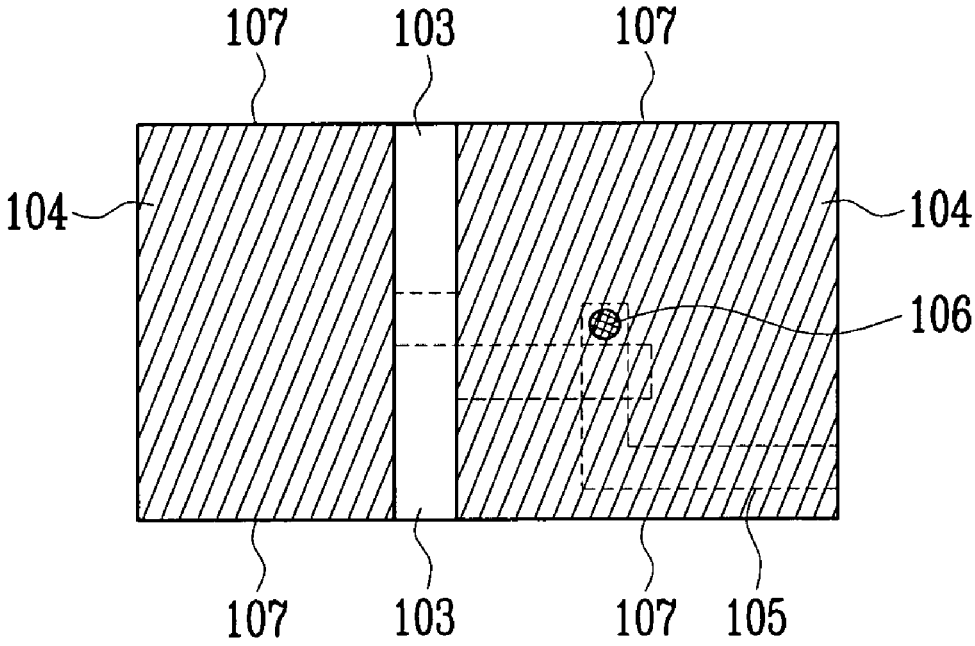
Figure 4C:
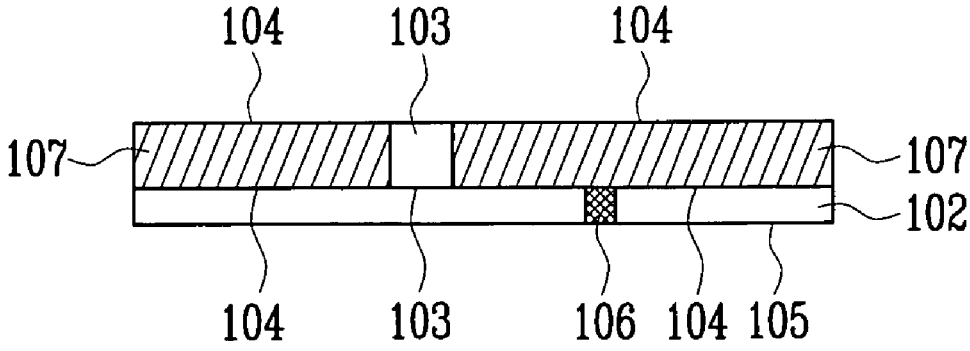

The connection units 107 carry out a connection function, may be provided in the form of conduction holes in the first dielectric substrate 101, and may be provided in the form of conduction walls in side surfaces of the first dielectric substrate 101 or the like, that is, may be provided in various forms without any special limitation. In FIG. 4A, the connection unit is provided in the form of conduction walls. FIGS. 4B and 4C are plan views seen from A and B directions respectively.

In the slot antenna of this embodiment, since each of the slots 103 is formed on a top and a bottom of the first dielectric substrate 101, the antenna has a length of $\lambda/4$, and therefore, the slot antenna of this embodiment has a half length in comparison with the conventional slot antenna.

Figure 5:
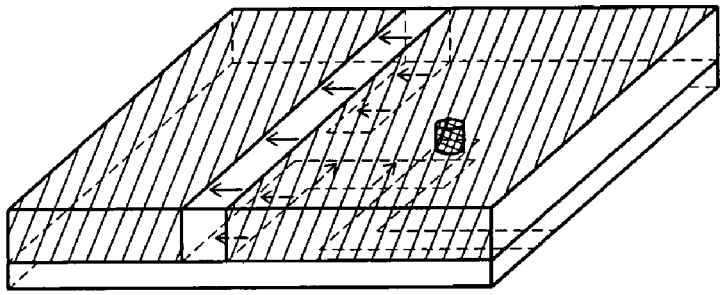
FIG. 5 is a view showing an electric field distribution formed by electric field energy applied to the slot antenna according to the first embodiment of the present invention.

In the slot antenna of this embodiment, it is preferable that electric fields, generated at each slot 103 formed on the top and the bottom of the first dielectric substrate 101, are formed in the same direction. FIG. 5 is a view showing an electric field distribution on the slot formed by electric field energy according to the first embodiment of the present invention. The slots 103 provided on the bottom of the first dielectric substrate 101 in FIG. 4A are constructed to form a bended "L" shape, but other slots 103 may be constructed to form a parallel shape on the top and the bottom of the first dielectric substrate 101, so that electric fields all over the slot 103 are generated in the same direction.

As described in this embodiment, electric fields on the top and the bottom of the slots 103 are formed in the practically same direction, thereby not being counterbalanced not similarly to the conventional meandered slot antenna, and therefore gain and radiation efficiency of the slot antenna of this embodiment are improved.

Figure 6:
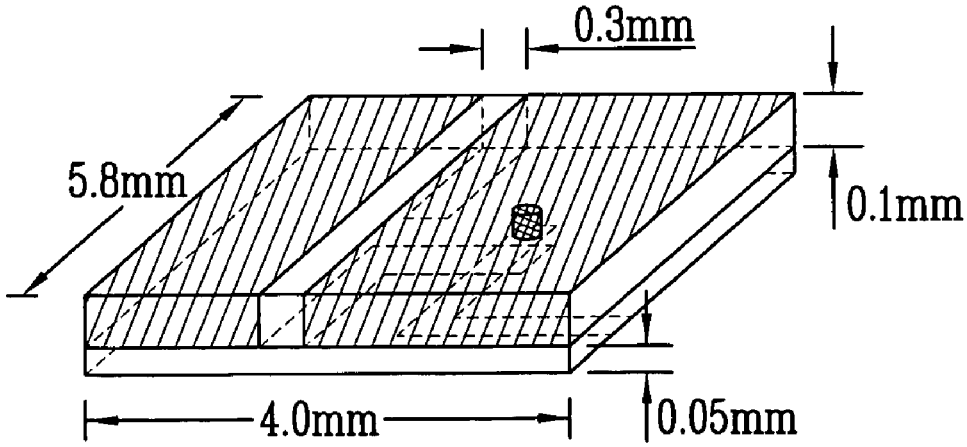
FIG. 6 is a view showing dimensions used in a simulation test of the slot antenna according to the first embodiment of the present invention.

The input impedance characteristic and the electromagnetic field radiation characteristic are calculated by performing a simulation test of the slot antenna according to the first embodiment. The slot antenna dimensions used in the simulation test are represented in FIG. 6. As shown in FIG. 6, a width of the slot is 0.3 mm, and a thickness, a permittivity, and a loss tangent of the first dielectric substrate are 0.1 mm, 12.9, and 0.002 respectively, and a thickness, a permittivity, and a loss tangent of the second dielectric substrate are 0.05 mm, 2.9, and 0.002 respectively. A center frequency of the slot is 5.775 GHz. In addition, total size of the slot antenna is 5.8 mm×4.0 mm.

Figure 7:
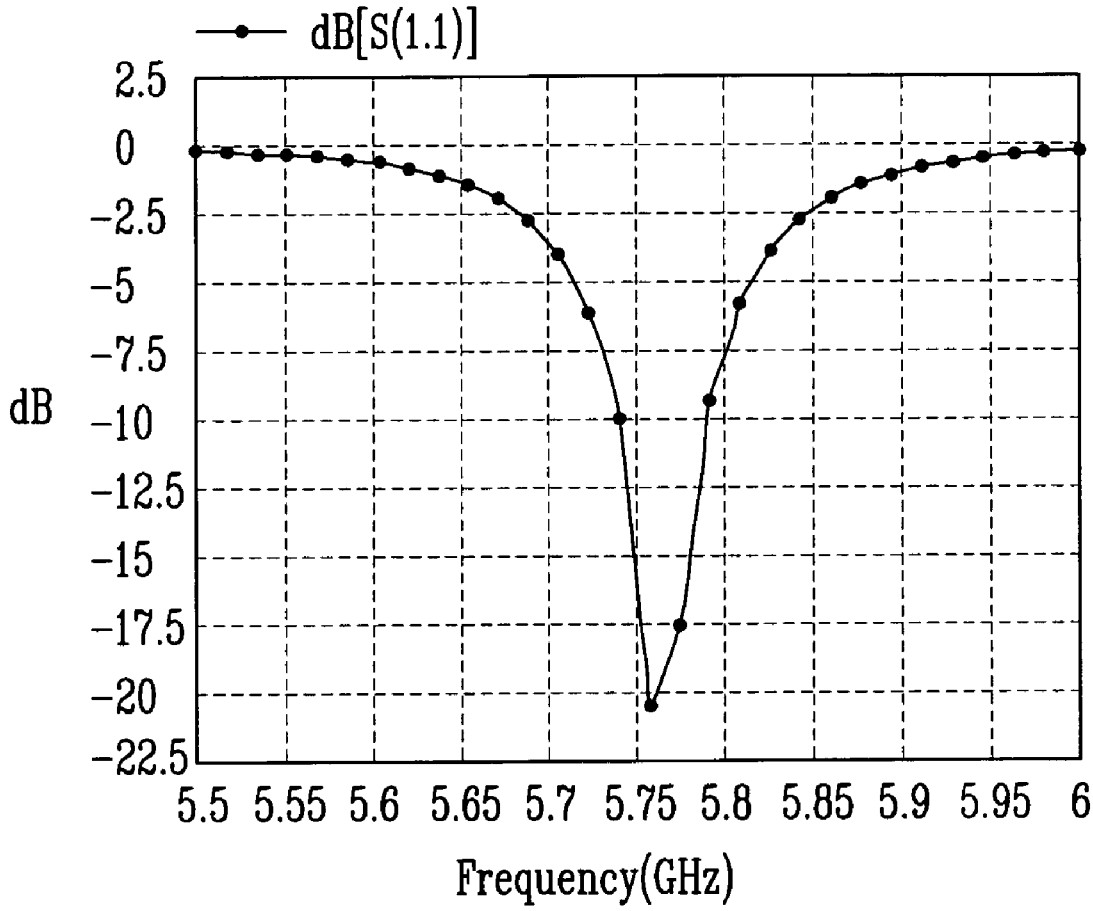
FIGS. 7 and 8 are views illustrating an input impedance characteristic and an electric field radiation characteristic with respect to the slot antenna according to the first embodiment of the present invention.
Figure 8:
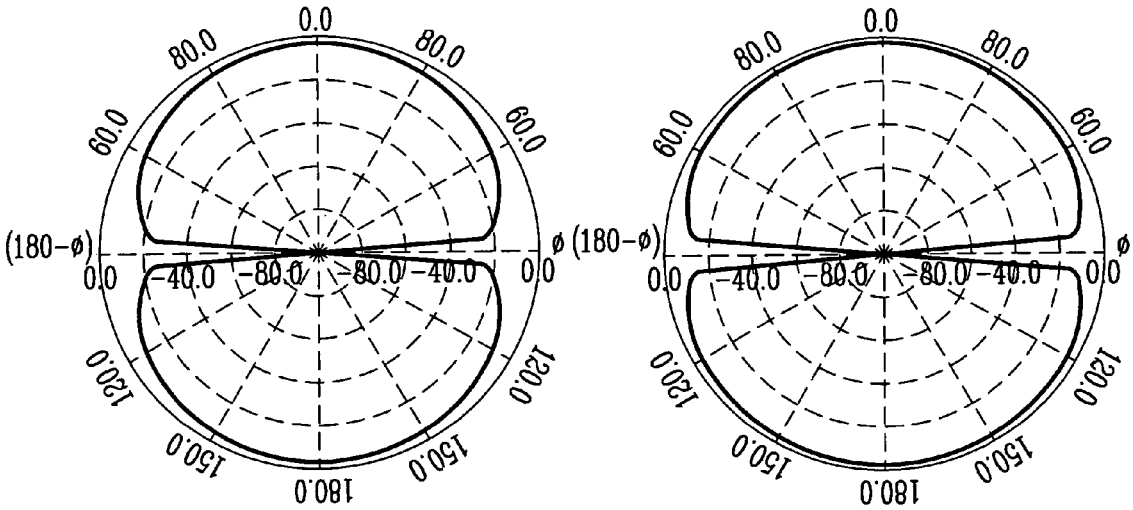

FIGS. 7 and 8 are views illustrating an input impedance characteristic and an electromagnetic field radiation characteristic of a slot antenna according to the embodiment of the present invention. FIG. 8 is a view showing radiation strength of an electromagnetic field in each direction on each of an E plane and an H plane, and each E plane and H plane is a vertical plane with respect to the dielectric substrate and is a vertical plane or a horizontal plane with respect to the slot in which electromagnetic field is radiated. The radiation efficiency of the slot antenna is about 26%, which is sufficiently larger than the radiation efficiency 10% (see table 1) of the meandered slot antenna. The characteristics of the slot antenna according to this embodiment are represented in table 2.

TABLE 2

| | |
|---|---|
| 10 dB FREQUENCY BAND WIDTH (MHz) | 50.0 |
| ANTENNA GAIN (dBi) | −3.0 |
| ANTENNA RADIATION EFFICIENCY (%) | 26.0 |

(Second Embodiment)

Figure 9A:
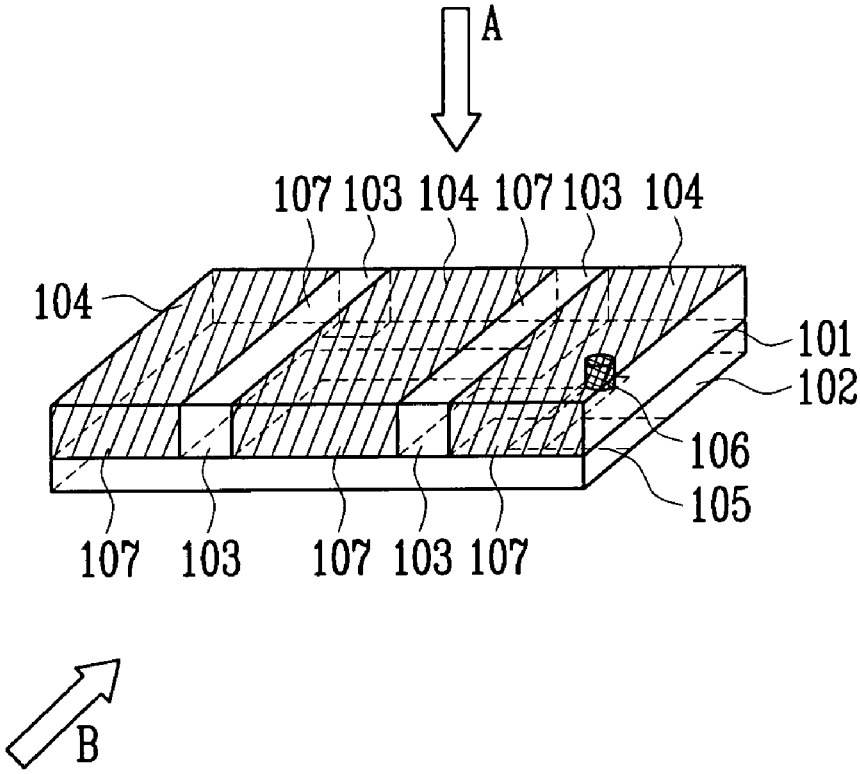
FIGS. 9A to 9C are views showing a slot antenna structure according to a second embodiment of the present invention.
Figure 9B:
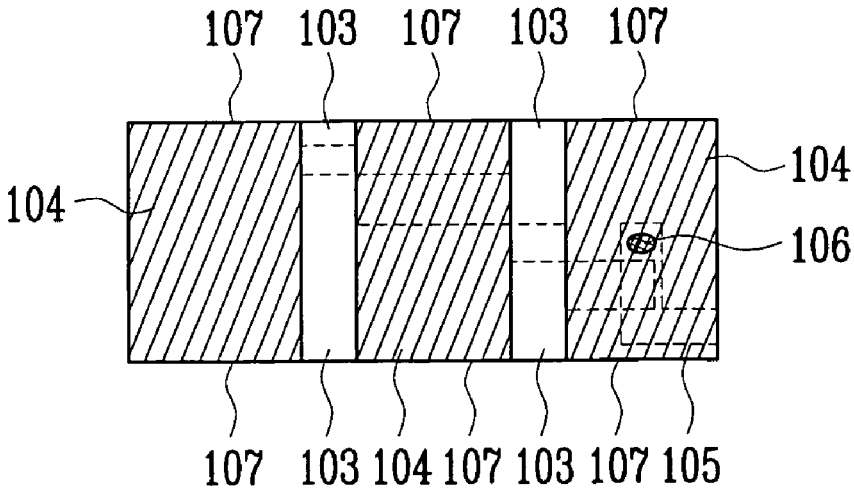
Figure 9C:
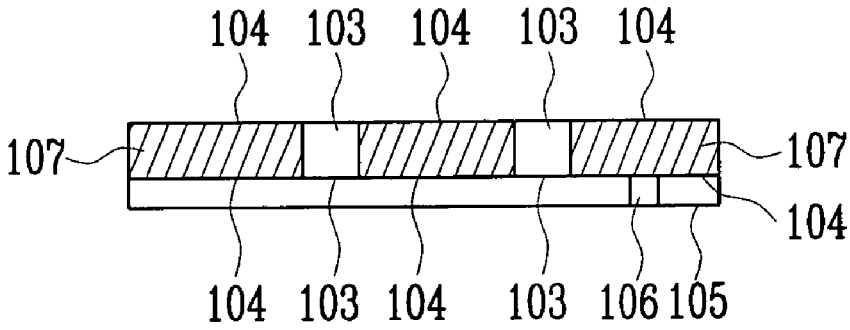

FIG. 9A is a view showing a slot antenna structure according to a second embodiment of the present invention. The slot antenna of FIG. 9A is constructed to have two slots on both sides of the first dielectric substrate 101, beneficially making it possible to reduce a length of the antenna in comparison with that of the first embodiment by bending again the bended slot 103 of the first embodiment. For convenience of explanation, the differences between the slot antenna of the first embodiment and that of the second embodiment will be mainly described in detail. FIGS. 9B and 9C are a plan view and a front view seen from the directions A and B in FIG. 9A respectively.

Figure 10:
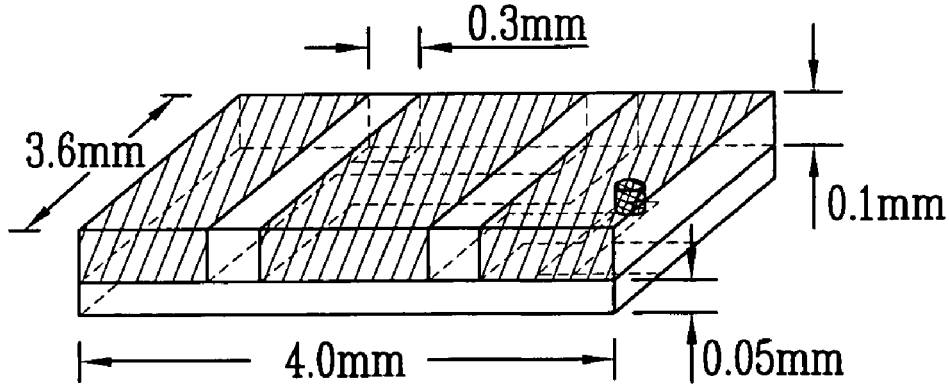
FIG. 10 is a view showing dimensions used in a simulation test of the slot antenna according to the second embodiment of the present invention.

The slot antenna comprises first and second dielectric substrates 101, 102 having a predetermined permittivity and a predetermined thickness, wherein the slots 103 are formed on both sides, that is, a top and a bottom of the first dielectric substrate 101 and a ground surface 104 is formed on each of a top and a bottom as a structure for defining the slot. A microstrip feed line 105 can be formed on a bottom of the dielectric substrate 102 to feed an electromagnetic field energy, and a conduction via hole 106 can be formed in the slot to match impedance of the microstrip feeding line. The slot antenna comprises slots 103 formed on the top and the bottom of the first dielectric substrate 101 and connection units (for example, conduction walls) 107 formed to connect with a ground surface 104. A shape of the slots 103 formed on both surfaces is different from that of the first embodiment. In the second embodiment, the slot 103 formed on the top of the first dielectric substrate 101 is constructed to iteratively repeat two bend shapes and the slot 103 formed on the bottom of the first dielectric substrate 101 comprises a portion for connecting between two bend-shaped portions. The input impedance characteristic and the electromagnetic field radiation characteristic are calculated by performing a simulation test of the slot antenna according to the second embodiment. The slot antenna dimensions used in the simulation test are represented in FIG. 10. A thickness, a permittivity, and a loss tangent of the first dielectric substrate are 0.1 mm, 12.9, and 0.002 respectively, and a thickness, a permittivity, and a loss tangent of the second dielectric substrate are 0.05 mm, 2.9, and 0.002 respectively. A center frequency of the slot is 5.775 GHz. In addition, total size of the slot antenna according to the second embodiment is 3.6 mm×4.0 mm smaller than that of the first embodiment.

Figure 11:
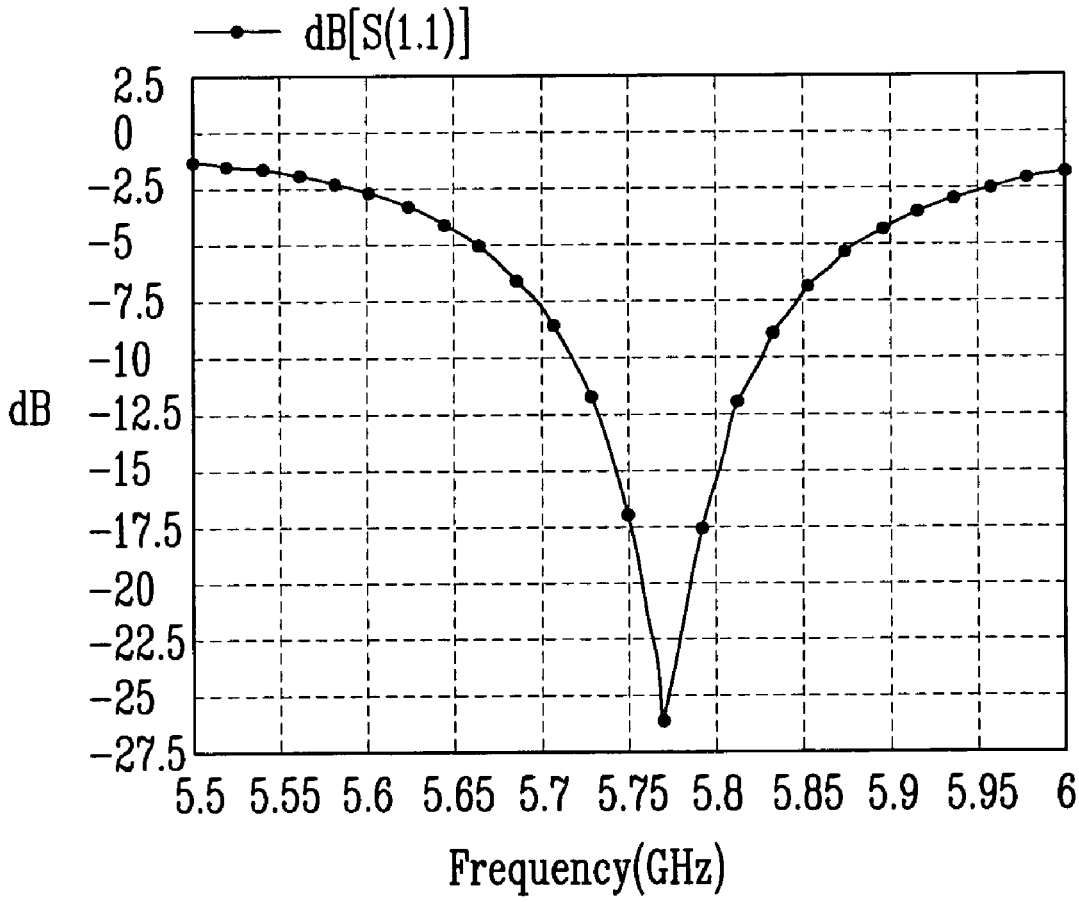
FIGS. 11 and 12 are views illustrating an input impedance characteristic and an electric field radiation characteristic according to the second embodiment of the present invention.
Figure 12:
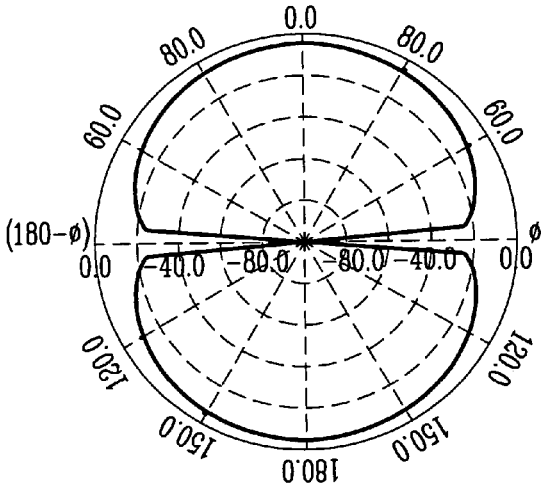
Figure 12:
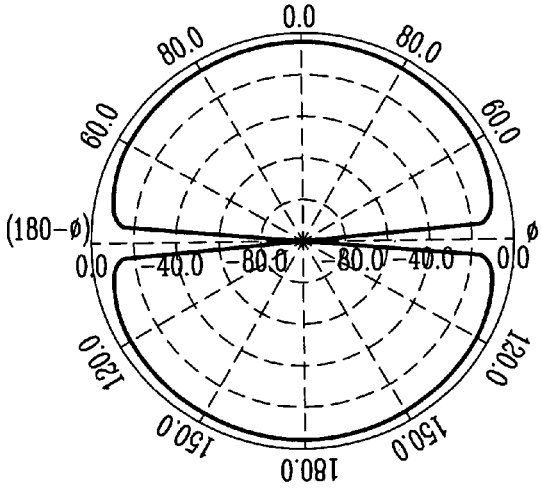

FIGS. 11 and 12 are views illustrating an input impedance characteristic and an electromagnetic field radiation characteristic of a slot antenna formed according to the aforementioned structure. The radiation efficiency of the slot antenna according to the second embodiment is about 18%, which is sufficiently larger than the radiation efficiency 10% (see table 1) of the meandered slot antenna. The characteristics of the slot antenna according to this embodiment are represented in table 3.

TABLE 3

| | |
|---|---|
| 10 dB FREQUENCY BAND WIDTH (MHz) | 100.0 |
| ANTENNA GAIN (dBi) | −4.6 |
| ANTENNA RADIATION EFFICIENCY (%) | 18.0 |

(Third Embodiment)

Figure 13A:
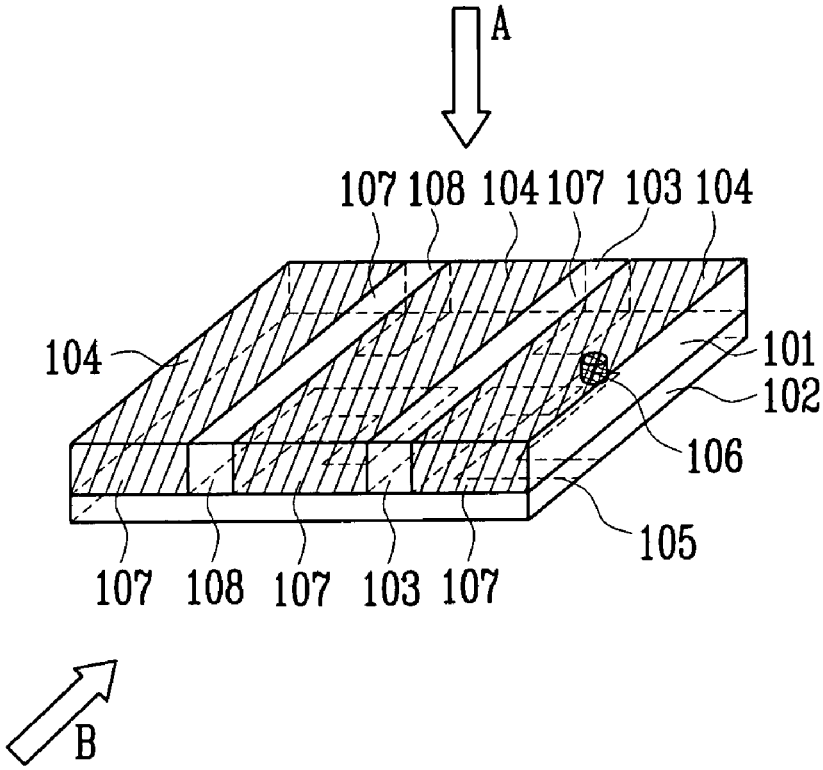
FIGS. 13A to 13C are views showing a slot antenna structure according to a third embodiment of the present invention.

FIG. 13A is a constructional view showing a slot antenna according to the third embodiment of the present invention. For convenience of explanation, the differences between the slot antenna of the third embodiment and that of the second embodiment will be mainly described in detail. According to the third embodiment, the first slot 103 and the second slot 108 formed on top and bottom of the first dielectric substrate 101 are constructed to iteratively repeat two bend shapes, wherein the two slots are not connected but are adjacent to each other not similarly to the second embodiment.

Figure 13B:
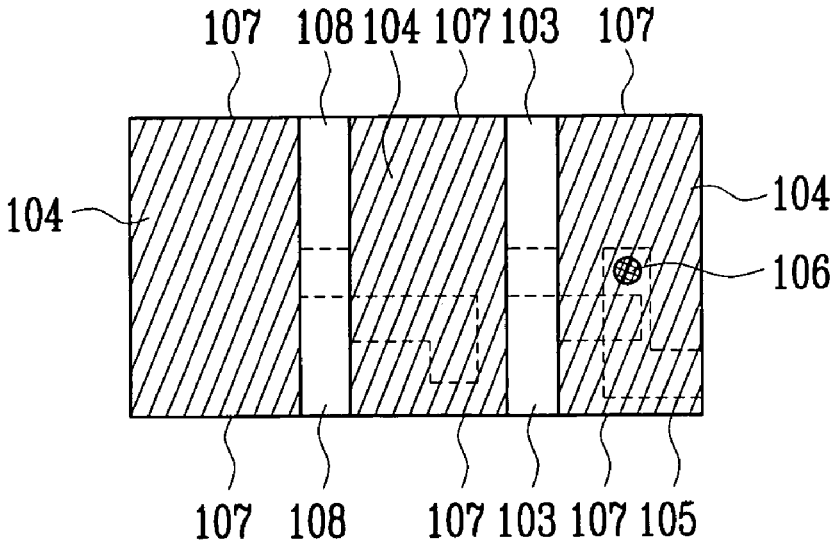
Figure 13C:
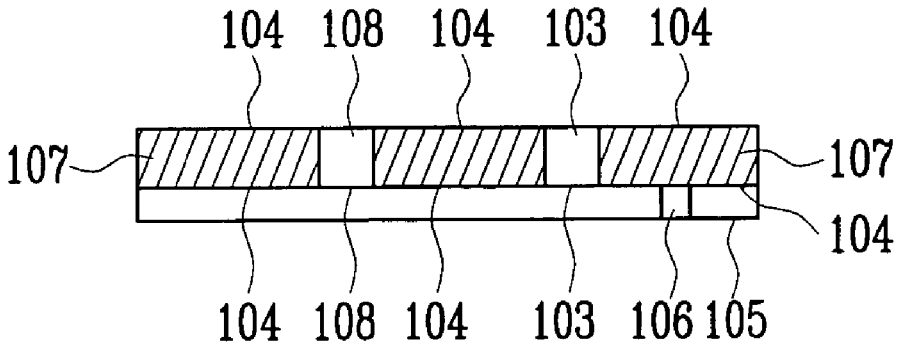

Comparing with the first embodiment, such a structure is constructed to form a slot antenna in which slots are formed on both sides of the first dielectric substrate 101, by adding the second slot 108 to the structure in which the first slot 103 is previously provided. FIGS. 13B and 13C are a plan view and a front view seen from the directions A and B in FIG. 13A with respect to the slot antenna according to the third embodiment, respectively.

In the slot antenna of the third embodiment, the second slot 108 is adjacent to the first slot 103 and is formed to have a length the practically same as a length of the first slot 103. At that time, coupling phenomenon is generated at a place adjacent to the first slot 103, thereby generating resonance in the second slot 108 at a frequency area adjacent to a resonant frequency of the first slot 103. Therefore, since the slot antenna resonates in two neighbor frequency areas, frequency bandwidth of the antenna can be extended. End shapes of the separated second slot 108 at a location utmost adjacent to the first slot 103 and the second slot 108 is preferably formed as shown in FIG. 13A. Namely, in order to improve the coupling effect of the second slot 108, the second slot can be constructed to have parallel ends with a predetermined length to the first slot 103.

Figure 14:
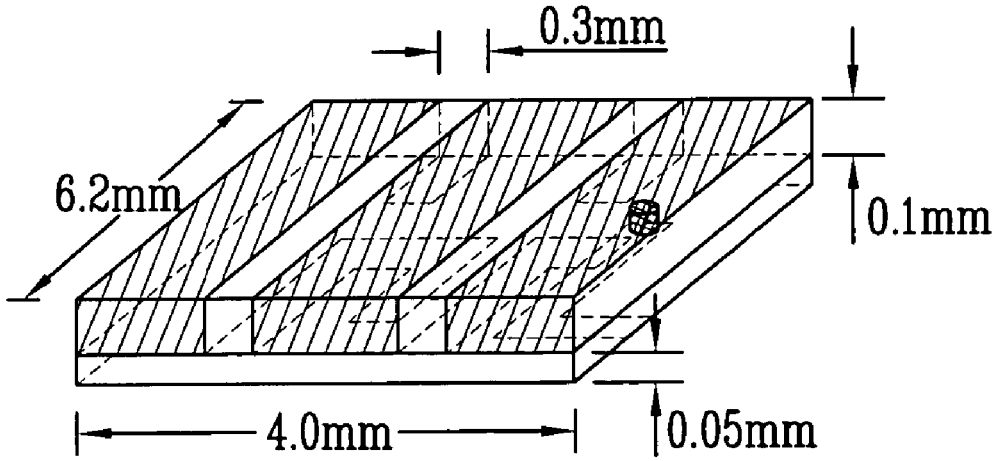
FIG. 14 is a view showing dimensions used in a simulation test of the slot antenna according to the third embodiment of the present invention.

The input impedance characteristic and the electromagnetic field radiation characteristic are calculated by performing a simulation test of the slot antenna according to the third embodiment. The dimensions of the slot antenna used in the simulation test are represented in FIG. 14. A thickness, a permittivity, and a loss tangent of the first dielectric substrate are 0.1 mm, 12.9, and 0.002 respectively, and a thickness, a permittivity, and a loss tangent of the second dielectric substrate are 0.05 mm, 2.9, and 0.002 respectively. A center frequency of the slot is 5.775 GHz. In addition, total size of the slot antenna according to the second embodiment is 6.2 mm×4.0 mm.

Figure 15:
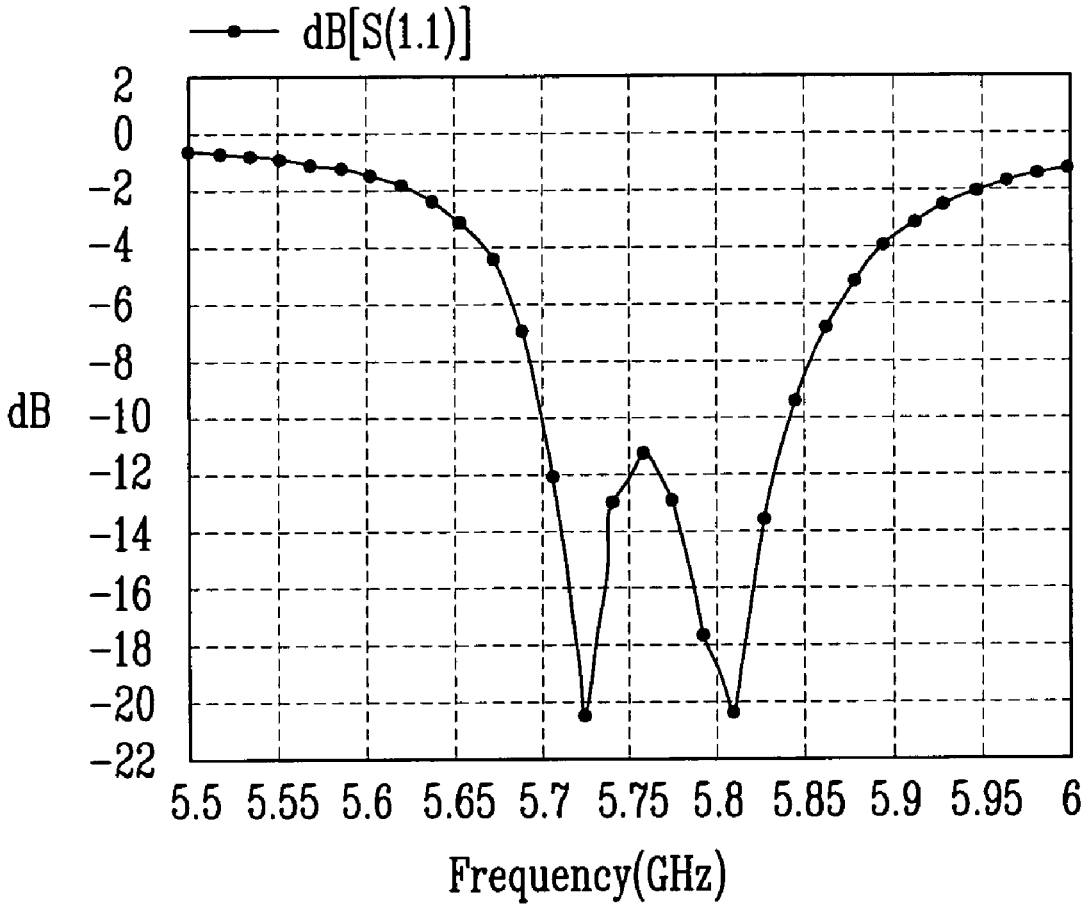
FIGS. 15 and 16 are views illustrating an input impedance characteristic and an electric field radiation characteristic with respect to the slot antenna according to the third embodiment of the present invention.
Figure 16:
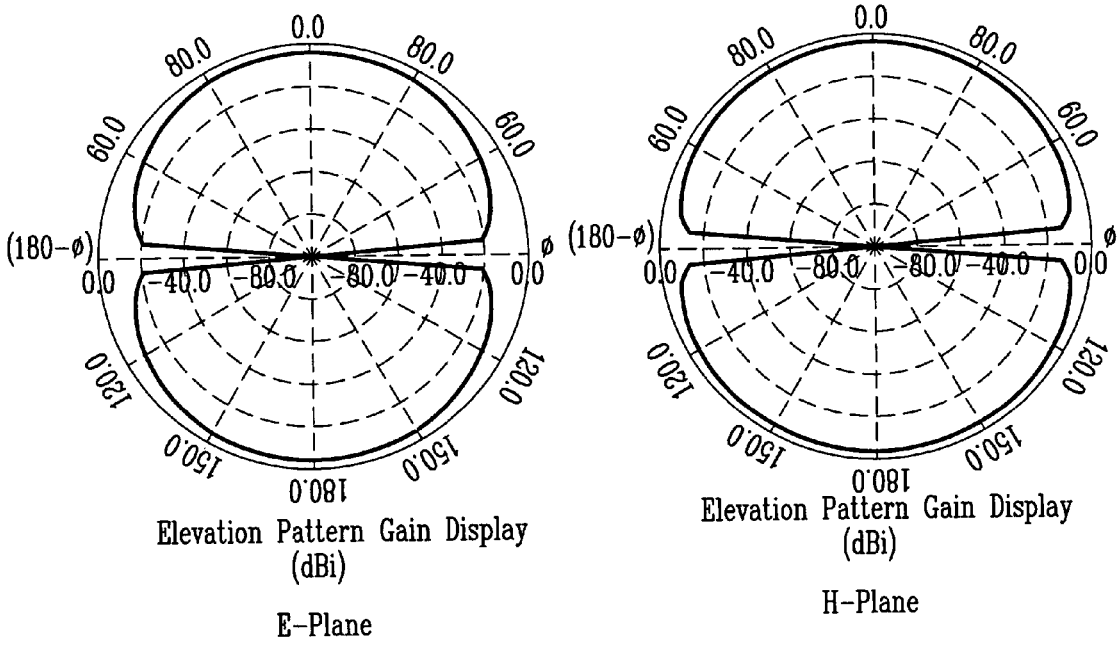

FIGS. 15 and 16 are views showing an input impedance characteristic and an electromagnetic field radiation characteristic of the slot antenna formed to have aforementioned structures. The radiation efficiency of the slot antenna of the third embodiment is about 28%, which is sufficiently larger than the radiation efficiency 10% (see table 1) of the meandered slot antenna. The characteristics of the slot antenna according to the third embodiment are represented in table 4.

TABLE 4

| | |
|---|---|
| 10 dB FREQUENCY BAND WIDTH (MHz) | 150.0 |
| ANTENNA GAIN (dBi) | −3.0 |
| ANTENNA RADIATION EFFICIENCY (%) | 26.0 |

(Fourth Embodiment)

Figure 17A:
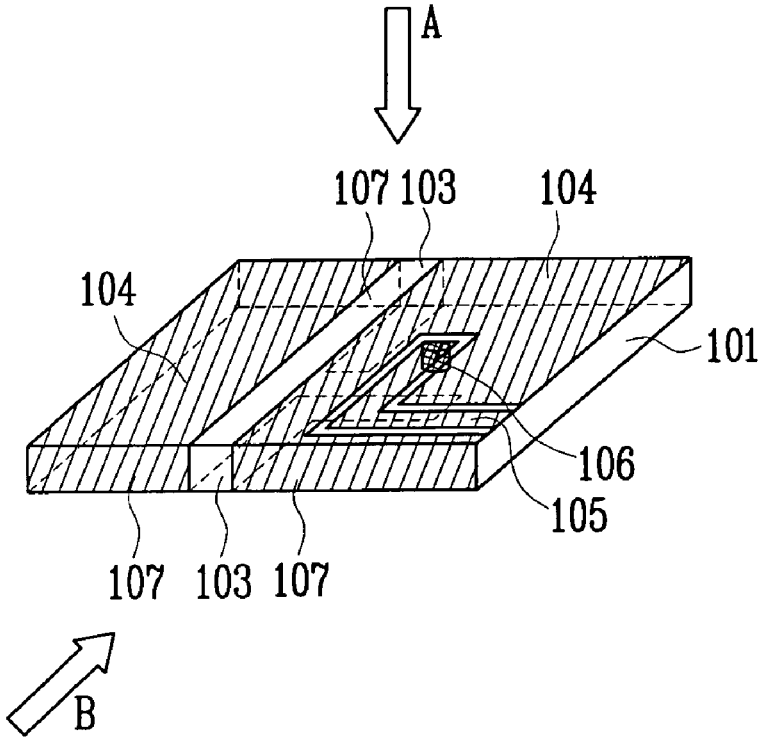
FIGS. 17A to 17C are views showing a slot antenna structure according to a forth embodiment of the present invention.
Figure 17B:
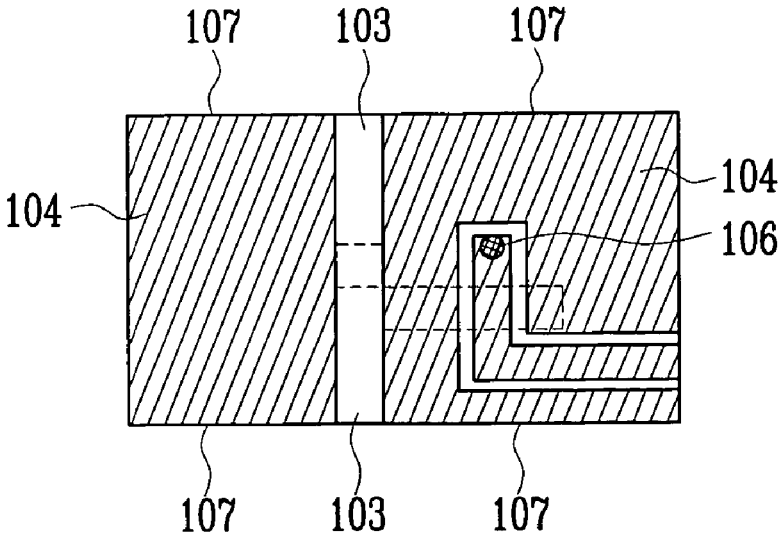
Figure 17C:
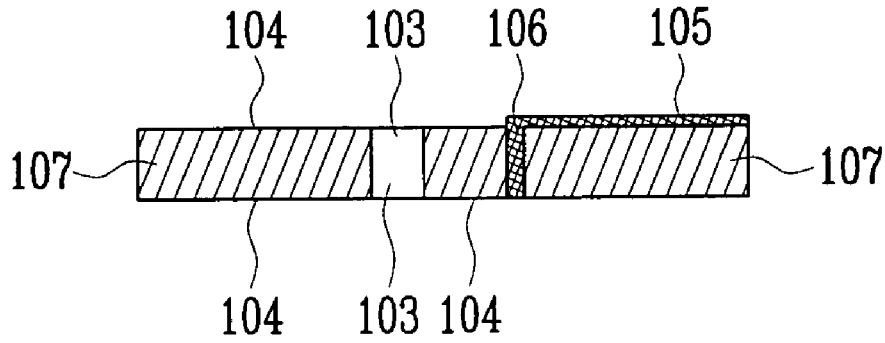

FIG. 17A is a view showing a slot antenna structure comprising a single dielectric substrate and slots formed on both sides of the slot antenna structure according to the fourth embodiment of the present invention. The slots 103 are formed on a top and a bottom of the single dielectric substrate 101, and a ground surface 104 for defining the slot 103. A microstrip feed line 105 is formed to have an isolation shape electrically isolated from the ground surface on the dielectric substrate 101. For example, the microstrip feed line 105 is connected to the ground surface formed on the bottom of the dielectric substrate 101 through contact holes, and the slot formed on the bottom is constructed to alternate with the microstrip feed line 105 formed on the top surface. According to the fourth embodiment, the microstrip line 105 and the slot 103 are concurrently formed on the dielectric substrate 101. Therefore, a slot antenna comprising a single dielectric substrate and slots formed on both sides of the single dielectric substrate not likely the first embodiment can be constructed. FIGS. 17B and 17C are a plan view and a front view seen from the directions A and B of FIGS. 17A with respect to the aforementioned slot antenna, respectively.

Figure 18:
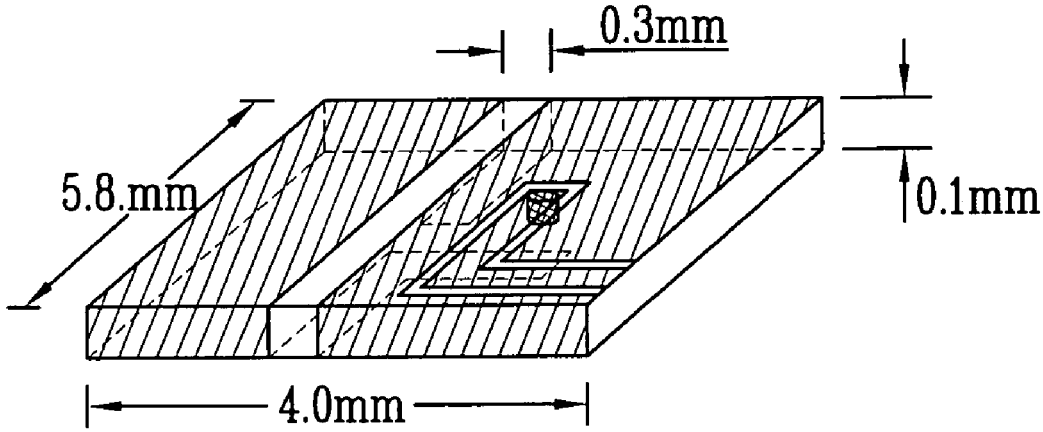
FIG. 18 is a view showing dimensions used in a simulation test of the slot antenna according to the forth embodiment of the present invention.

The input impedance characteristic and the electromagnetic field radiation characteristic are calculated by performing a simulation test of the slot antenna according to the fourth embodiment. The dimensions of the slot antenna used in this simulation test are represented in FIG. 18. A thickness, a permittivity, and a loss tangent of the dielectric substrate are 0.1 mm, 12.9, and 0.002 respectively. A center frequency of the slot is 5.775 GHz. In addition, total size of the slot antenna according to the fourth embodiment is 5.8 mm×4.0 mm.

Figure 19:
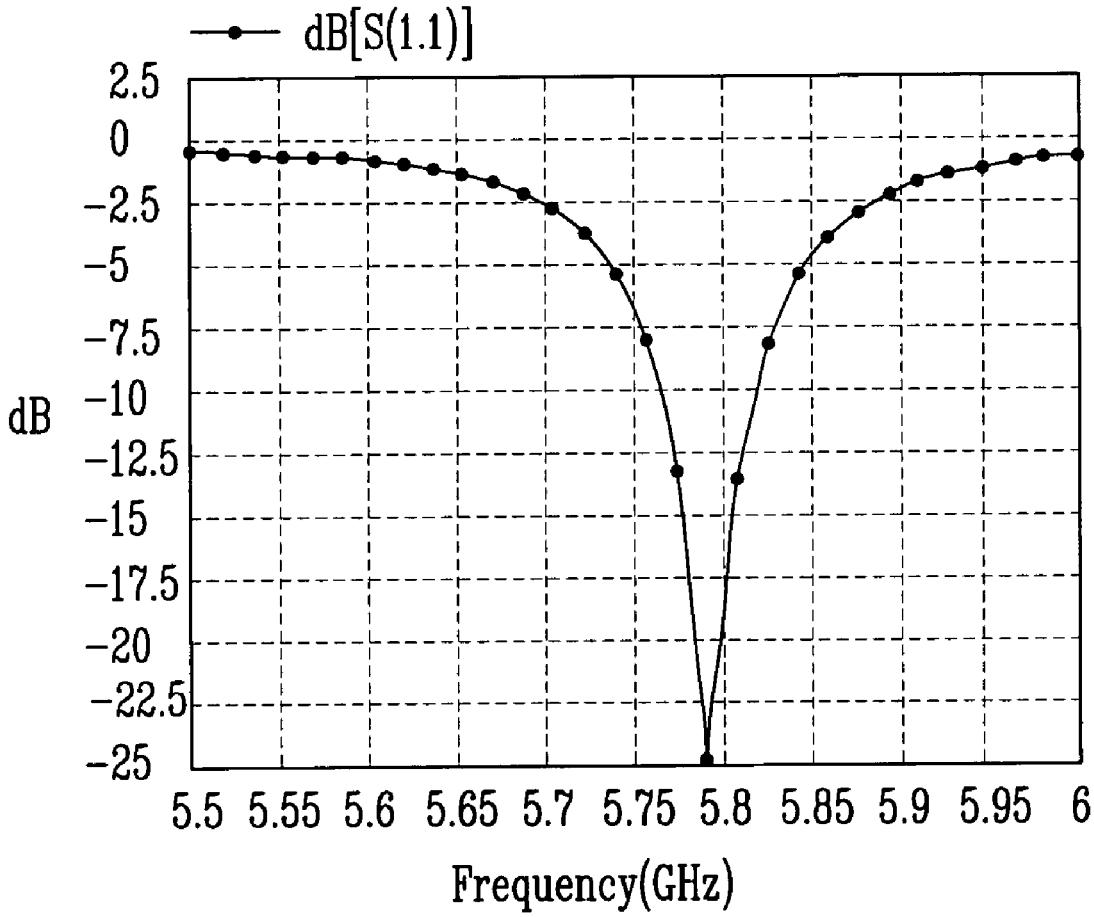
FIGS. 19 and 20 are views illustrating an input impedance characteristic and an electric field radiation characteristic according to the forth embodiment of the present invention.
Figure 20:
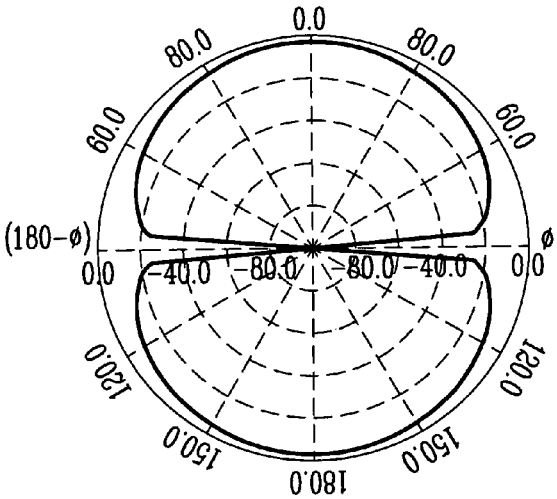
Figure 20:
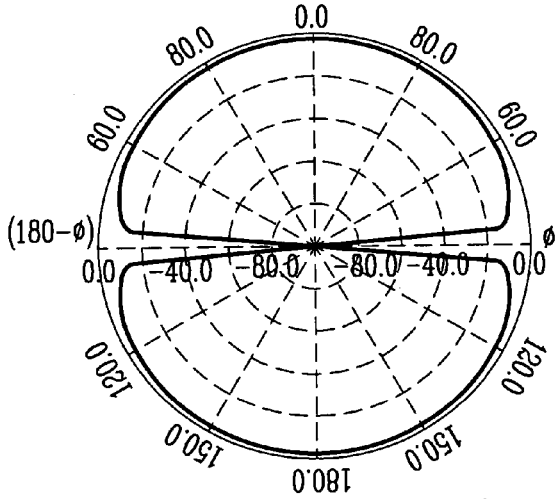

FIGS. 19 and 20 are views showing an input impedance characteristic and an electromagnetic field radiation characteristic of the slot antenna formed to have aforementioned structures. The radiation efficiency of the slot antenna of the third embodiment is about 23%, which is sufficiently larger than the radiation efficiency 10% (see table 1) of the meandered slot antenna. The characteristics of the slot antenna according to the fourth embodiment are represented in table 5.

TABLE 5

| | |
|---|---|
| 10 dB FREQUENCY BAND WIDTH (MHz) | 50.0 |
| ANTENNA GAIN (dBi) | −3.5 |
| ANTENNA RADIATION EFFICIENCY (%) | 23.0 |

(Fifth Embodiment)

Figure 21A:
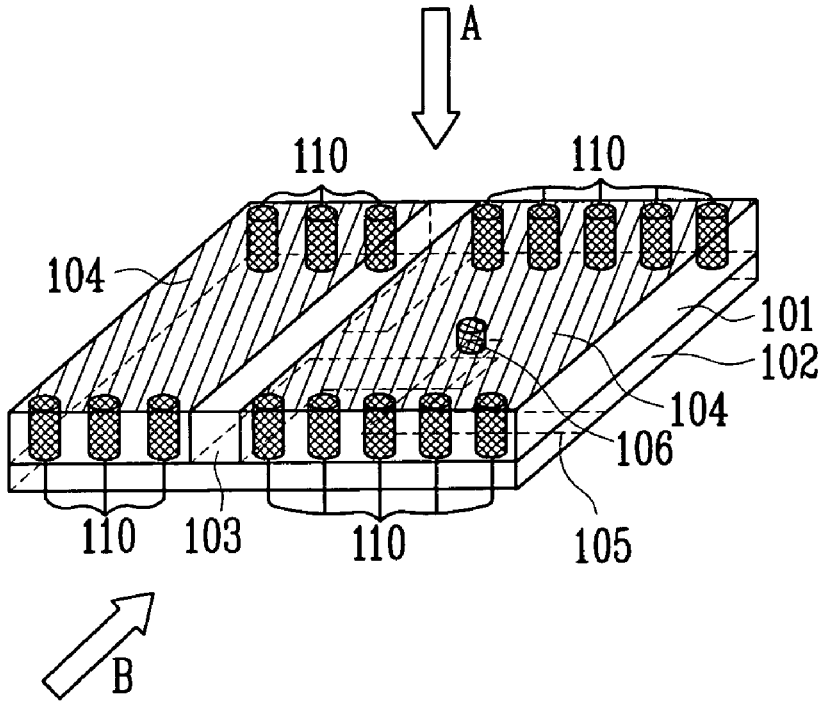
FIGS. 21A to 21C are views showing a slot antenna structure according to a fifth embodiment of the present invention.
Figure 21B:
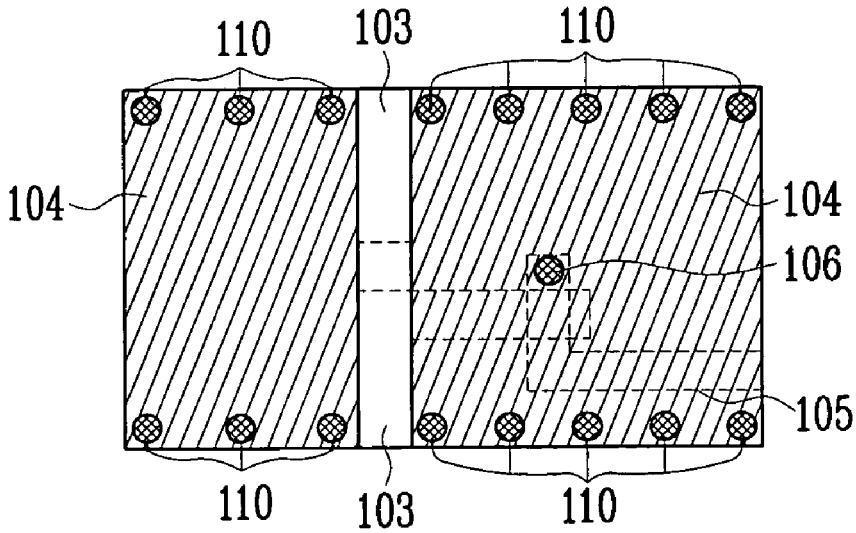
Figure 21C:
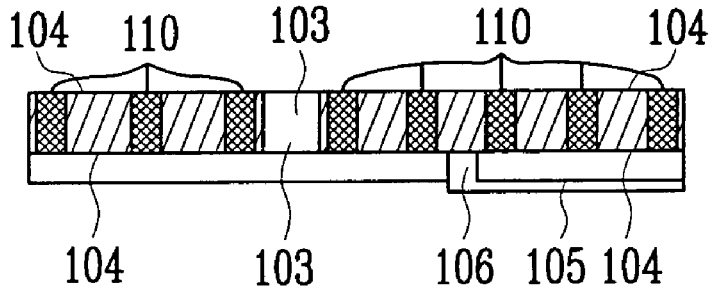

FIG. 21A is a view showing a slot antenna structure according to the fifth embodiment of the present invention. For convenience of explanation, the differences between the slot antenna of the fifth embodiment and that of the first embodiment will be mainly described in detail. A plurality of conduction holes 110 instead of conduction walls 107 in the first embodiment are formed on side surfaces of the first dielectric substrate 101. The slots 103 formed on the top and the bottom of the first dielectric substrate 101 are connected to each other and the ground surfaces are connected to each other. The slot antenna having slots formed on both sides of the dielectric substrate can be constructed by a relatively easy manufacturing method using a plurality of conduction holes 110 instead of the conduction walls 107. FIGS. 21B and 21C are a plan view and a front view seen from the directions A and B of FIG. 21 A with respect to the slot antenna, respectively.

Figure 22:
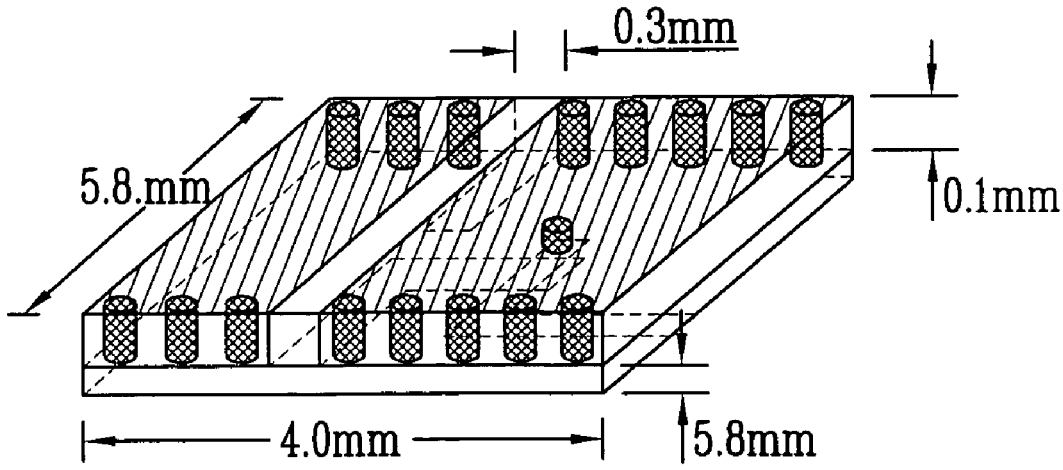
FIG. 22 is a view showing dimensions used in a simulation test of the slot antenna according to the fifth embodiment of the present invention.
Figure 23:
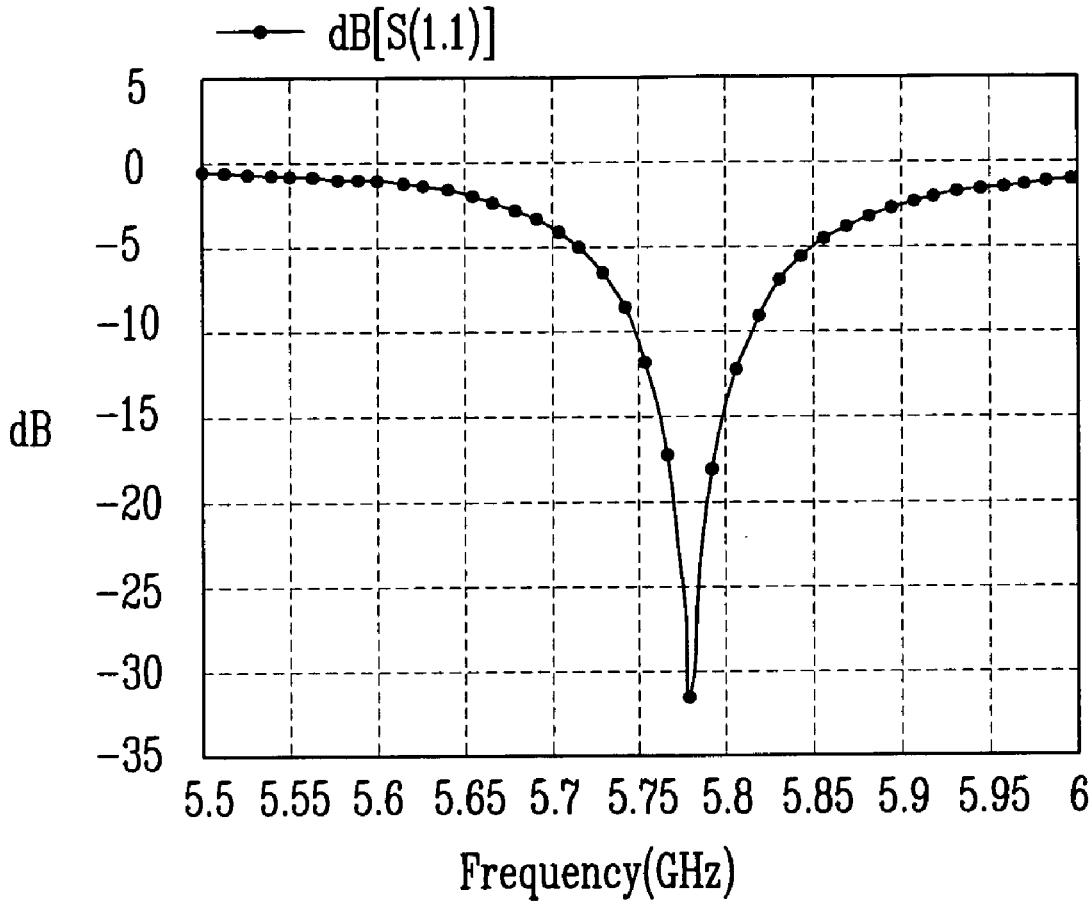
FIGS. 23 and 24 are views illustrating an input impedance characteristic and an electric field radiation characteristic according to the fifth embodiment of the present invention.
Figure 24:
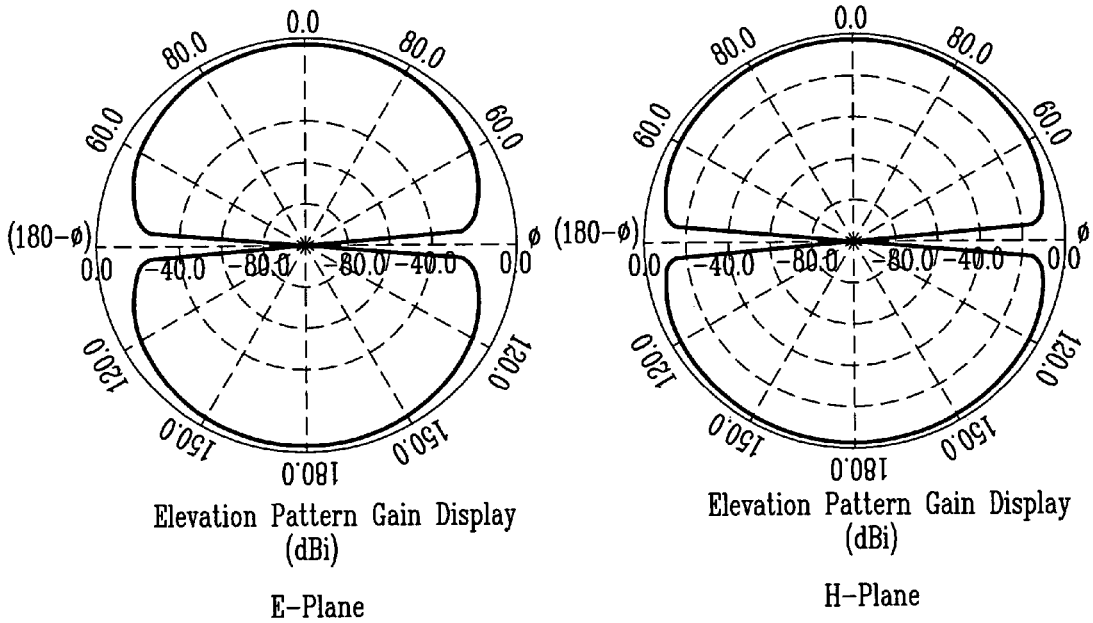

The input impedance characteristic and the electromagnetic field radiation characteristic are calculated by performing a simulation test of the slot antenna according to the fifth embodiment. The dimensions of the slot antenna used in this simulation test are represented in FIG. 22. FIGS. 23 and 24 are views showing an input impedance characteristic and the electromagnetic field radiation characteristic of a slot antenna formed to have the aforementioned structure, respectively, and the radiation efficiency of the slot antenna according to the fifth embodiment is about 18%. Characteristics of such a slot antenna are represented in table 6.

TABLE 6

| | |
|---|---|
| 10 dB FREQUENCY BAND WIDTH (MHz) | 60.0 |
| ANTENNA GAIN (dBi) | −4.0 |
| ANTENNA RADIATION EFFICIENCY (%) | 18.0 |

Furthermore, it is understood that the present invention can be implemented into various changes and modifications by those who skilled in the art without departing from the scope of the present invention.

As described above, according to the present invention, it is possible to construct the compact and lightweight antenna and obtain a higher gain and radiation efficiency characteristic in comparison with the conventional meandered slot antenna by forming slots of the conventional slot antenna on both sides of a dielectric substrate and connecting the slots of the both sides and a ground surface using conduction walls or conduction holes.

What is claimed is:

1. A slot antenna, comprising;

slots formed on a top and a bottom of a dielectric substrate;

ground surfaces formed on the top and the bottom as a structure for defining the slots; and a microstrip feed line formed on the top of the dielectric substrate, and electrically isolated from the ground surface on the top of the dielectric substrate, and a connection unit connecting the microstrip feed line and the ground surface on the bottom of the dielectric substrate, wherein a portion of the microstrip feed line is overlapped with the slots formed on the bottom of the dielectric substrate.

2. The slot antenna, according to claim 1, wherein the electric fields on the top and the bottom of the dielectric substrate are generated in the same direction.

* * * * *